United States Patent [19]

Pryke

[11] 4,038,827

[45] Aug. 2, 1977

[54] PILE

[75] Inventor: John Fordham Speaight Pryke, Broxbourne, England

[73] Assignee: Pynford Limited, London, England

[21] Appl. No.: 671,021

[22] Filed: Mar. 26, 1976

[30] Foreign Application Priority Data

July 25, 1975 United Kingdom ..... 31323/75

[51] Int. Cl.[2] ..... E02D 5/34

[52] U.S. Cl. ..... 61/53.62; 61/53

[58] Field of Search ..... 61/53.6, 53.54, 53.58, 61/53.68, 53.5, 53, 53.52, 53.62

[56] References Cited

U.S. PATENT DOCUMENTS

| | | | |
|---|---|---|---|
| 1,181,141 | 2/1916 | Johnson | 61/53.6 |
| 1,443,306 | 1/1923 | Blumenthal | 61/53.62 X |
| 3,054,268 | 9/1962 | Muller | 61/53.58 X |
| 3,332,247 | 7/1967 | Proctor | 61/53 |
| 3,526,069 | 9/1970 | Deike | 61/53.68 X |
| 3,763,655 | 10/1973 | Galuska | 61/53.68 |
| 3,855,745 | 12/1974 | Patterson et al. | 61/53.68 |

FOREIGN PATENT DOCUMENTS

| | | | |
|---|---|---|---|
| 469,716 | 7/1938 | United Kingdom | 61/53.6 |
| 139,253 | 6/1961 | U.S.S.R. | 61/53.5 |

*Primary Examiner*—Dennis L. Taylor
*Attorney, Agent, or Firm*—Martin P. Hoffman

[57] ABSTRACT

A friction pile has an elongate columnar body which extends at least 1 m. down into the ground and is arranged to carry a structural load at its upper end. A number of rods or other elongate elements, each of smaller cross-sectional area than said body, are connected at their upper ends to the pile body and extend in a direction with a downward component into the ground to shed at least a major portion of the structural load into the ground. At least some of the elongate elements extend outwards and downwards from the side of the pile body.

17 Claims, 9 Drawing Figures

36
33
37
38
34
35
21
22
29
28
20
27
26
25
24

46
45
44
44
28
24

47
49
20
48
48
28A
48
28
28

50
52
51
28B

PILE

The invention relates to friction piles which are provided in the ground for supporting structural loads. Such a pile is usually a solid column of material such as steel or concrete, which is either hammered downwards into the ground by means of a pile driver, or is formed in situ in a hole bored in the ground. In use the pile sheds its load into the ground primarily through skin friction between its outer surface and the surrounding stable earth. The maximum safe load which a pile can support is therefore proportional to its circumference, that is proportional to its diameter, whereas the size and weight of the pile, and the volume of spoil which has to be removed when a pile is formed in situ is proportional to the cross-sectional area of the pile, that is proportional to the square of the diameter. As a result conventional piles are generally unwieldy and a great deal of effort and site disturbance is necessary to put them down. It follows that when utilizing conventional friction piles to support foundation beams or slabs or underpinning beams, as few piles as possible are put down and the slab or beam is made correspondingly strong to span between adjacent piles.

In copending application Ser. No. 671,023 of David Speaight Pryke filed Mar. 26, 1976, and aassigned to the assignee hereof, there is disclosed a pile comprising an elongate columnar body which extends at least 1 m. downwards into the ground and is arranged to carry a structural load at its upper end and a number of elongate elements, each of smaller cross-sectional area than the body, which are connected at their upper ends to the pile body and extend in a direction with a downward component into the ground to shed at least a major portion of the structural load into the ground.

The pile may be formed by forming in the ground a hole generally of the shape and size of the pile body, forcing the elongate members downwardly into the ground through the wall of the hole, and providing in the hole a pile body connected to the upper ends of the elongate members.

The elongate members may be rods of a non-corrosive material such as stainless steel, carbon fibre, or a plastics material.

The upper ends of the rods may be embedded within the pile body which comprises an in situ cast material, such as epoxy resin or a cementitious grout, with the optional inclusion of reinforcement or preformed members. Alternatively the upper ends of the rods may be connected to a casing forming the pile body.

The aggregate circumferential area of the elongate elements may exceed that of the pile body, whilst the load bearing capacity of the pile will approach the aggregate load bearing capacity of the individual elements, so that the new pile having a given load bearing capacity can be put down through a smaller hole at ground level, as compared to a conventional pile of constant cross-section throughout its length. This has the advantage of requiring simpler drilling equipment, less spoil, and less disturbance adjacent for example to a house to be underpinned. In other words the projecting elements significantly increase the effective diameter (or cross-sectional dimension in the case of a pile body of non-circular section) of the pile and the increase in effective diameter leads to an increase in safe loading that may amount to a factor of eight or more. This reduction in size for a given load bearing capacity makes it economical to put down piles at more closely spaced intervals than previously, enabling foundation slabs or beams, such as underpinning beams, to be made thinner.

The actual load bearing capacity of a pile, the body of which has a given diameter, can be determined as necessary by putting down the appropriate number of elongate elements, taking into account the soil conditions.

The new piles are particularly suitable for use in cohesive soils, such as clay, but the pile may also be useful in coarser grained soils, such as sand. In permeable soils the ground through which the elements penetrate may be strengthened with a grout.

The elements may be formed into the ground individually or in groups using a reaction much less than the full load bearing reaction of the finished pile. This further simplifies the jacking or other equipment necessary to put down the pile.

As particularly described in the copending application, the elongate elements extend downwards from the bottom of the pile body. However, if all of the elongate elements extend downwards from the bottom of the pile body, the cross-sectional area at the bottom of the prebored hole through which the individual elements are driven is a limiting factor. Only a maximum number of elements can be accommodated and they must be spaced sufficiently for their surfaces to react frictionally with stable earth.

This limitation can be overcome if, in accordance with the present invention, at least some of the elongate elements extend outwards and downwards from the side of the pile body. These elements preferably extend from different angular positions around the periphery of the pile body and from different axially spaced positions along the length of the pile body, such as in superposed conical layers each consisting of a ring of the rods.

In this way a larger number of elongate elements may be utilized, and need not be made as thick or as long as elements extending downwards only from the bottom of the pile body to provide the same load bearing capacity.

When elements are to be forced downwards at an inclination through the sides of the preformed hole, this will generally involve the use of a deflector in the hole, which deflects the rods outwards as they are pushed axially down the hole. For example the deflector may be an upwardly pointing conical member and the rods are forced into the ground in successive rings working from the bottom of the hole upwards. The rods of each ring may then be connected at their upper ends to a common member and the members of successive rings are forced downwardly by means of a reciprocating driving member. The members may be annular collars and the driving member may be a central core which passes through the collars to locate each collar and ring of rods during driving. Separate deflectors may be provided between each ring of rods, or a common deflector may be successively drown up the hole for cooperation with each ring of rods.

A further possibility is the pre-assembly of all the rings of rods necessary for a pile in superposed overlapping layers on a core or within a casing. Each ring of rods may then be coupled to an expansible collar which, when pre-assembled is small enough to nest within the rods of the ring above, but which upon driving is expanded, for example by means of a deflector forming part of the collar of the ring of rods immediately below, or by means of a member which is successively raised up the hole by a central core. The tips of the pre-assembled rods may cooperate with deflector collars as previously, but when a casing is used for the pre-assembly, they may cooperate with deflector holes or deflector rings of the casing. The whole assembly is inserted into the hole and the rings of rods are driven in successively, for example by a successively rising reciprocating action of a central core, which cooperates in a ratchet-like manner with each ring in turn.

The hole through the sides of which the inclined rods are driven is not necessarily prebored. It may be driven by a pilot foot on the lower end of a mandrel, such as the core on which the assembly of rods are mounted. The driving of the hole has the advantage that it acts to consolidate the surrounding earth and hence provide a greater reaction for the inclined rods.

The pile body will normally be grouted solid as a final step. Alternatively, however, the pile body might be a hollow cylinder to which the upper ends of the rods or other elongate elements are attached. The body may then be formed by connecting together cylindrical collars each of which is attached to the upper end of a separate ring of the rods.

Although the invention is applicable to piles of any size, a particular advantage is the possibility of using slender piles at closely spaced intervals in foundation construction or stabilization or for use in underpinning load bearing walls. In that case the pile body may have a diameter of up to 150 mm, if the pile is to have a load bearing capacity of say up to 5 tons. The pile may be formed in a hole having a similar diameter although if it is necessary to protect the upper portion of the pile body against lateral movement of surrounding unstable earth, it may be necessary to provide a larger prebored hole and to fill the space around the upper portion of the pile body with a fluent or crushable material, or leave it as a void. By way of example, the slender pile may have a length in excess of 6 m. with the elongate elements projecting from the lower 2 m. or 3 m. of the pile body. The elongate elements may themselves be between 200 mm. and 3 m. long; between 2 mm. and 15 mm. in diameter; and may number from 20 up to several hundred.

The possibility of constructing the pile through a small prebored hole makes it feasible, when underpinning buildings, to insert inclined pile through a hole bored through the existing wall above or beneath the inner dampproof course without penetrating the inner face of the wall above floor level but with the axis of the support close to the inner face of this wall, thus minimising eccentric loading of the piles via a new foundation beam to which the tops of the piles are united.

Some examples of piles constructed in accordance with the invention are illustrated in the accompanying drawings, in which.

Figure 3:
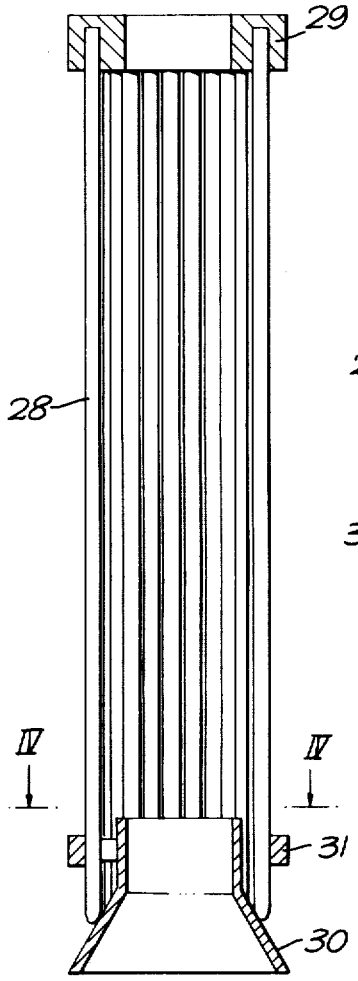
FIG. 3 is another sectional view corresponding to part of FIG. 1 to a larger scale.
Figure 4:
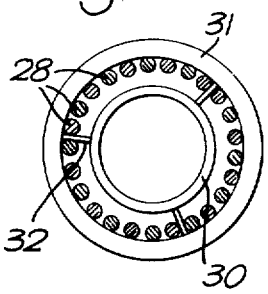
FIG. 4 is a section taken on the line IV—IV in FIG. 3.
Figure 5:
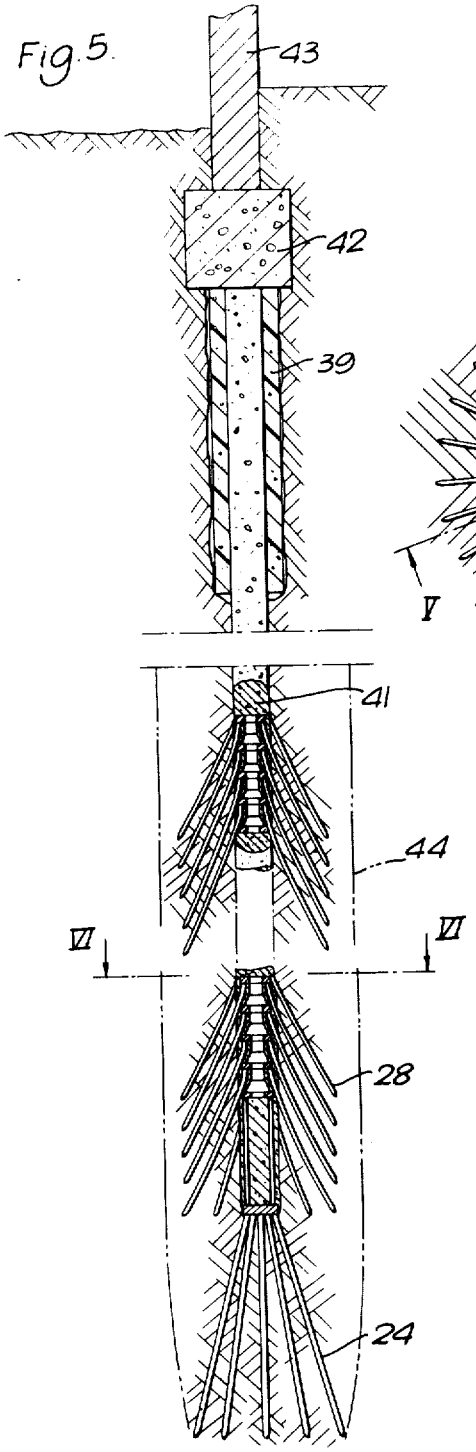
FIG. 5 is a section corresponding to FIG. 1 showing the finished pile.
Figure 6:
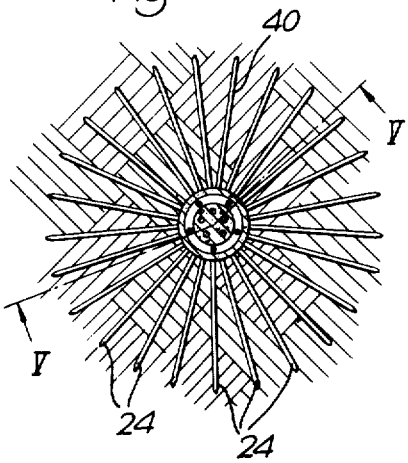
FIG. 6 is a section taken on the line VI—VI in FIG. 5.

The first pile illustrated in FIGS. 1 to 6 is constructed by first drilling at 75 mm. diameter hole 20 about six metres into the ground, at least the lower three metres being into stable earth. The upper three metres of the hole 20 is then prebored at 21 to a dimeter of 150 mm. A driving core 22, formed in a number of sections screwed together, is then lowered down the hole. The lowermost section of the core 22 is provided with a pair of dimetrically opposed outwardly spring-loaded ratchet teeth 23. A number of sets of rods are then threaded onto the core 22 and slipped down the hole. The lowermost rod set, which is put down the hole before the core 22, is different from the others and comprises a ring of twentyfour 450 mm. long 10 mm. diameter stainless steel rods 24 the upper ends of which are bonded into bores in a base plate 25 which is in turn connected by a sleeve 26 to an annular collar 27. Each rod set above the lowermost one is as illustrated in FIGS. 3 and 4 and consists of a ring of twentyfive 400 mm. long 3 mm. diameter stainless steel rods 28 the upper ends of which are bonded into bores in a mild steel annular collar 29 and the lower ends of which are jammed in an annular space between a frusto-conical deflector 30 and a guide ring 31 which is fixed to an upper cylindrical extension of the deflector by webs 32.

A jacking unit, exemplified in the drawings by a manually operated chain jack 33, although it could also be a light duty hydraulic jack, is brought into association with the top of the core 22 at ground level. The illustrated chain jack 33 is shown diagrammatically as being held down by weights 34 or pickets 35. The jack has a driving member 36 which abuts a collar 37 which is slipped laterally onto the core 22 at an appropriate height by cooperation with an appropriate pair of notches 38.

Figure 1:
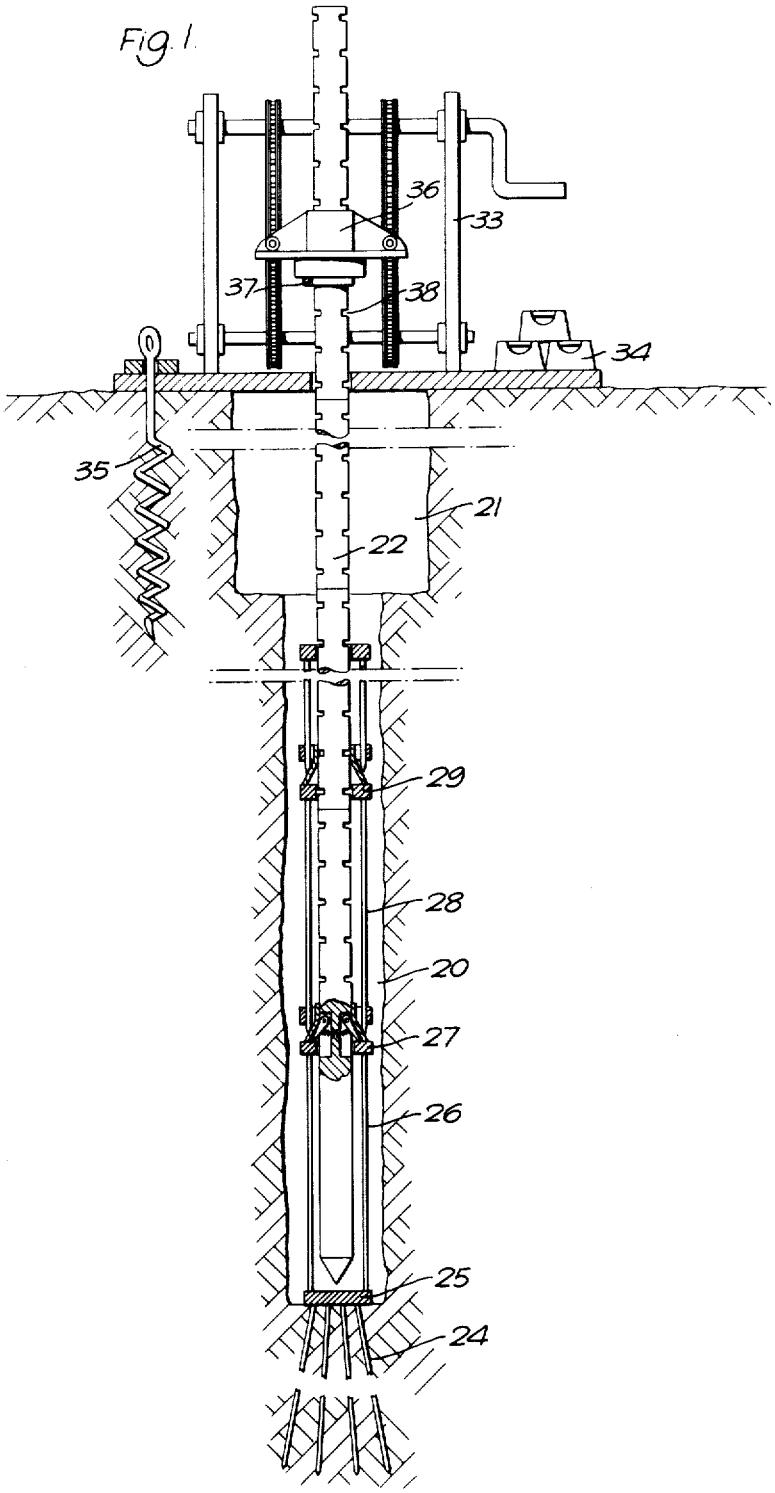
FIG. 1 is a vertical sectional view illustrating the method of putting down one pile.
Figure 2:
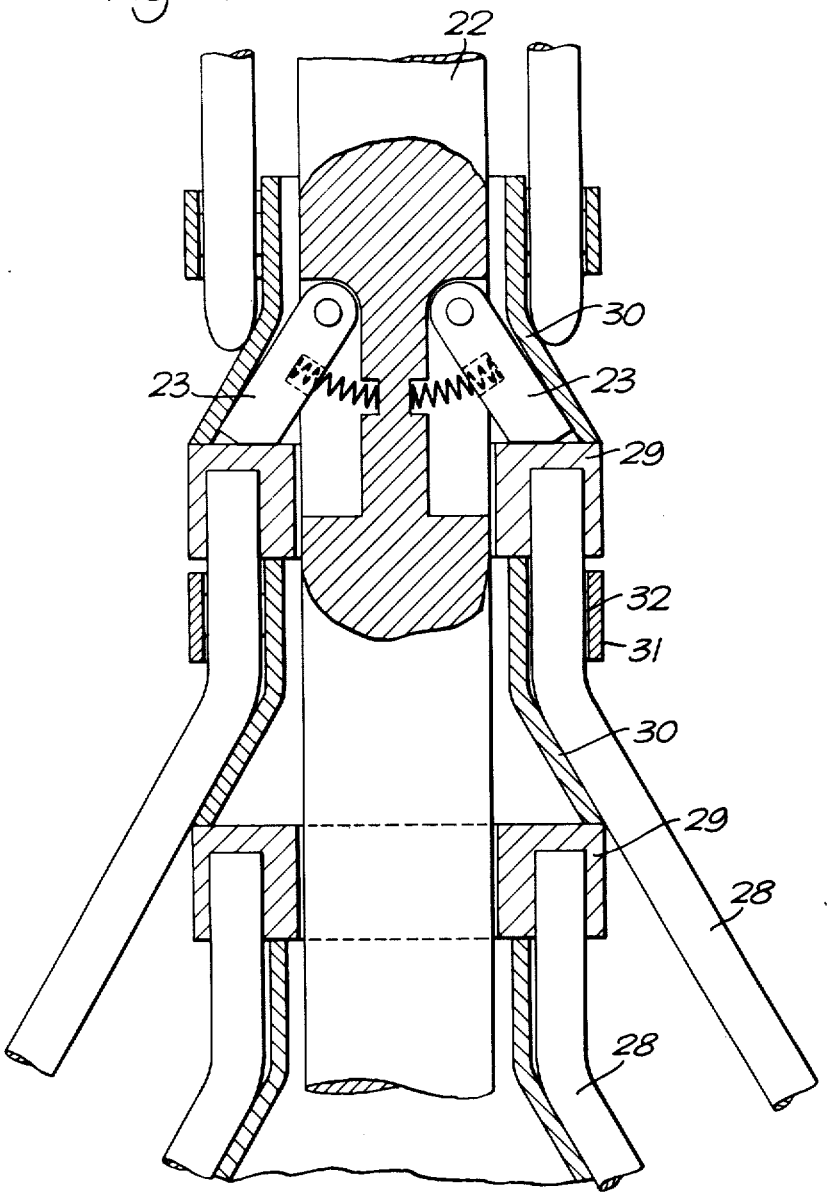
FIG. 2 is a sectional view corresponding to part of FIG. 1 to a larger scale.

The bottom rod set is first driven down to the FIG. 1 position by engagement of the ratchet teeth 23 with the top of the collar 27 and forcing the core 22 downwards by means of the jack 33. As the rods 24 are forced into the ground, they splay apart slightly.

After the bottom rod set have been driven, the jack 33 is used to raise the rod 22 until the ratchet teeth 23 snap outwards into position above the collar 29 of the next rod set. If necessary after changing the position of the collar 37, the jack 33 then forces the core 22 downwards again forcing the next rod set downwards. The leading ends of the rods 28 are deflected outwards by the appropriate deflector 30 and force themselves at an inclination downwards into the ground through the side of the hole 20. This continues until the appropriate collar 29 abuts against the cylindrical extension of the deflector 30 as shoown in FIG. 2. The core 22 is raised again and the operation repeated as many times as necessary. Further rod sets may be threaded onto the top of the core 22 and allowed to slide down into their position to be driven.

After all the rod sets have been driven, the core 22 is withdrawn, a cylindrical sleeve 39 of expanded polystyrene is inserted into the hole 21 to fill the counterbore, reinforcement rods 40 are if necessary inserted downwards through the sleeve 39 and collars 29 and the holes are grouted up with an epoxy resin to form a solid pile body 41. The tops of a number of piles may then be united with a common pile cap 42 for supporting a building structure 43. The load will be shed into a volume of ground indicated by the chain dotted line 44 in FIG. 5, which is seen to be very much greater than that of the pile body 41.

Figure 7:
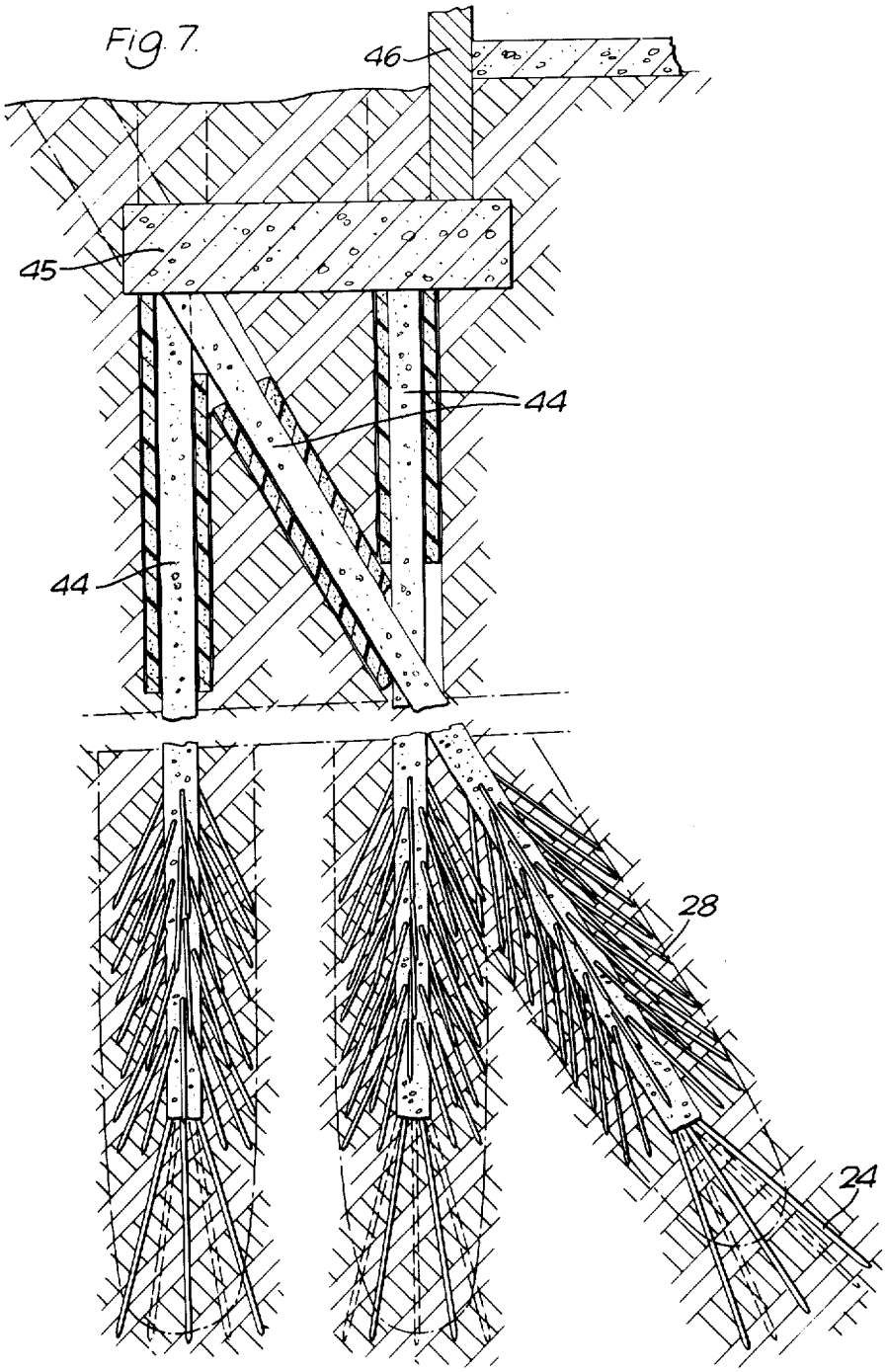
FIG. 7 illustrates the use of the piling technique in an underpinning operation; and, FIGS. 8 and 9 are diagrammatic sectional views showing the construction of second and third examples of pile.

FIG. 7 shows a number of the new piles 44 put down vertically or at an inclination, and united by a pile cap 45 for underpinning a structure 46. In FIG. 7 only a few of the rods 24 and 28 are shown for simplificity but in practice many more may be used.

Figures 8, 9:
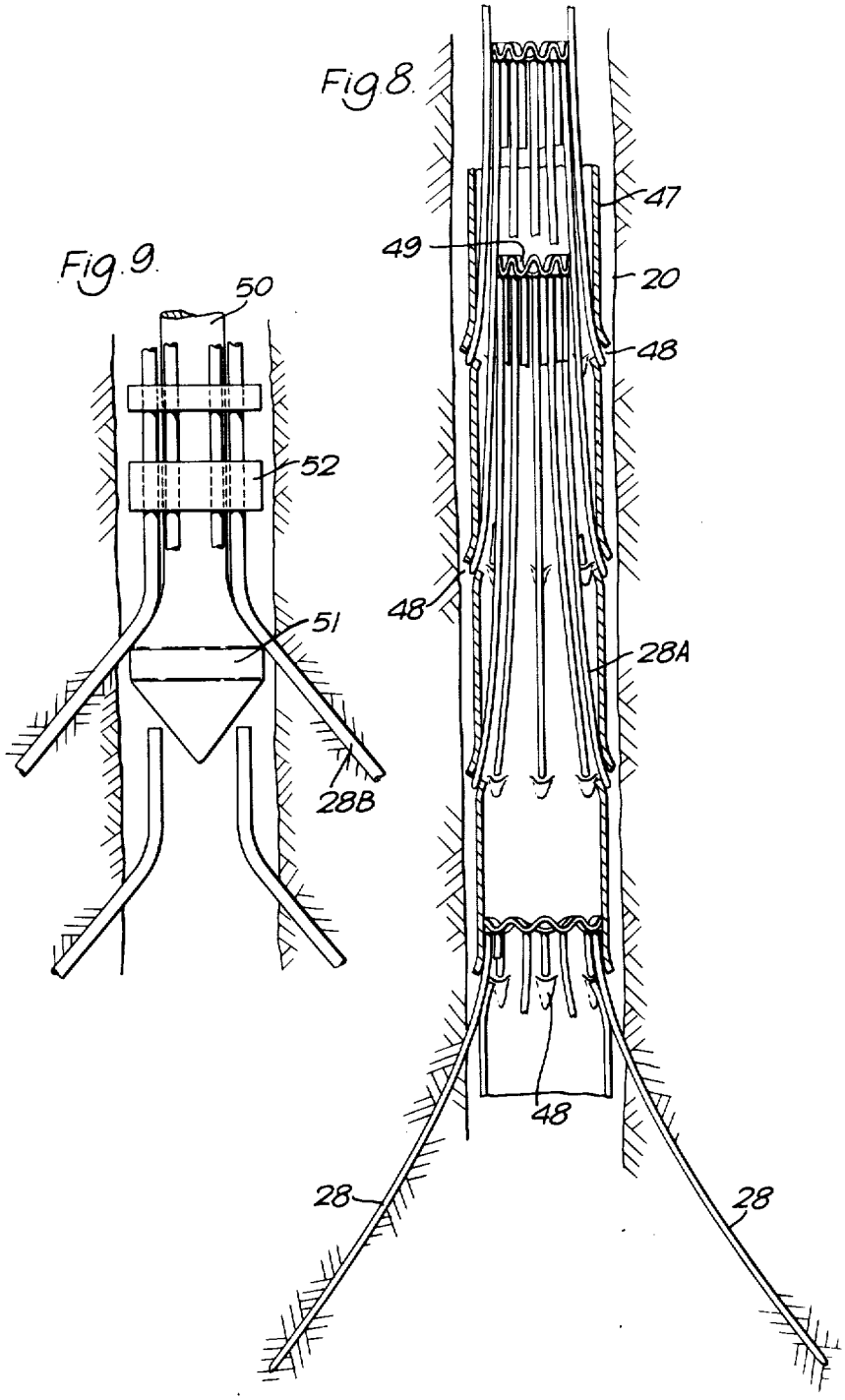

FIG. 8 shows a modification in which the rod sets are introduced down the hole preloaded into a steel casing 47 with the tips of the rods 28A initially located in deflector holes 48 in the wall of the casing. In this case the rods 28A are fixed at their upper ends to a corrugated collar 49 to allow for expansion during driving. The rod sets may be driven by reciprocating core 22 utilizing ratchet teeth 23 exactly as in the first example.

FIG. 9 shows a further example in which a guide core 50 having a deflector head 51 is inserted down the hole 20 and continuous lengths of rod are guided down the sides of the core. The rods are advanced down the core by a ram jack so that the free ends of the rods are deflected outwards by the head 51 and penetrate the ground. When the necessary penetration has been achieved, the rods are cut by a remote controlled cutter 52 and the core 50 is raised to the next driving position, the head 51 forcing its way past the upper ends of the just driven ring of rods 28B. Finally the core 50 is withdrawn and the hole 20 is grouted up as before as indicated at 53.

I claim:

1. A pile comprising:

a. an elongated columnar body extending into a hole in the ground that approximates the size and shape of said columnar body, b. a first plurality of elongated elements extending axially within said body, c. said first plurality of elongated elements projecting downwardly beyond said columnar body through the bottom of the hole and into the ground, d. a second plurality of elongated elements extending outwardly and downwardly from the side of the pile body and into the ground surrounding the pile, e. each one of said first and second plurality of elongated elements having a smaller cross-sectional area than said columnar body, and f. said columnar body being formed of a cast in situ material that has the ends of said first and second plurality of elongated elements embedded therein.

2. A pile as defined in claim 1 wherein said second plurality of elongated elements comprises several superposed layers of elongated elements situated at axially spaced positions along the length of said pile body.

3. A pile as defined in claim 1 wherein said second plurality of elongated elements is distributed throughout a range of angular positions around the periphery of said pile body.

4. A pile as defined in claim 1 wherein the aggregate circumferential area of the elongated elements exceeds the circumferential area of the columnar body.

5. A pile as defined in claim 1 wherein the hole is pre-bored in the ground, the lower portion of the hole approximating the size of the lower portion of the columnar body and the upper portion of the hole being considerably larger than the upper portion of the columnar body, thus defining a void between the columnar body and the surrounding ground.

6. A pile as defined in claim 5 wherein the void is filled with a fluent material, the fluent material preventing shifting of the ground from damaging the columnar body of the pile.

7. A pile as defined in claim 1 wherein said pile further includes a plurality of annular collars spaced axially along the length of said columnar body, the upper ends of said elongated elements being secured to said collars and the free ends of said elongated elements extending downwardly and outwardly therefrom.

8. A pile as defined in claim 7 further including deflector means spaced axially along the length of said columnar body for deflecting the free ends of the second plurality of elongated elements downwardly and outwardly when axial forces are applied to the annular collars.

9. A pile as defined in claim 8 wherein said deflector means comprises at least one frusto-conical member.

10. A pile as defined in claim 8 wherein said deflector means includes a hollow cylindrical member with a plurality of holes spaced along the length of, and angularly distributed thereabout, to facilitate the passage of the rods outwardly and downwardly therefrom.

11. A pile as defined in claim 1 wherein each one of said first plurality of elongated elements is thicker and longer than each one of said second plurality of elongated elements.

12. A method of forming a pile comprising an elongated columnar body adapted to carry a structural load at its upper end, a first plurality of elongated elements, and a second plurality of elongated elements, each of the elongated elements being of smaller cross-sectional area than said body, each of said elements being connected at its upper end to said body, the method comprising the steps of:

a. forming a hole in the ground approximating the size and shape of the columnar body of the pile, b. inserting said first plurality of elongated elements into the hole, c. applying forces to said first plurality of elongated elements to drive the bottom ends thereof downwardly into th ground through the bottom of the hole, d, inserting deflector means into the hole, e. uniting said second plurality of elongated elements with collar means, f. inserting said second plurality of elongated elements and collar means into the hole, g. applying forces to said collar means so that said second plurality of elongated elements contact the deflector means and are forced thereby downwardly and outwardly through the wall of the hole into the ground, and h. grouting the hole to form a solid pile body which has the upper ends of the first and second plurality of elongated elements and the collar means embedded therewithin.

13. The method of claim 12 wherein the upper end of the hole is counter-bored to define an annular void between the periphery of the hole and the pile body.

14. The method of claim 12 wherein the collar means comprises several axially Spaced collar means, the method further comprising the steps of joining each collar to the upper ends of a ring elongated elements prior to inserting the collar and deflector means into the hole.

15. The method of claim 14 further including the step of elevating the deflector means from the bottom of the hole so that said deflector means cooperates with each of the several spaced collars in sequence.

16. The method of claim 14 wherein the forces are applied to the elongated elements by reciprocating driving member that assumes the form of a central core, the method further including the step of passing the driving member through the collars to locate each collar and ring of the elongated elements prior to applying forces thereto.

17. A method of forming a pile comprising an elongated columnar body adapted to carry a structural load at its upper end, a first plurality of elongated elements, a second plurality of elongated elements, each of the elongated elements being of smaller cross-sectional area than said body, each of said elements being connected at its upper end to said body, the method comprising the steps of:

a. assembling said second plurality of elongated elements into superposed overlapping rings with the upper ends of the elongated elements joined to axially spaced annular collars located within a guide core, b. positioning deflector means along the axial length of the guide core and positioning the first plurality of elongated elements at the lower end of the guide core, c. forming a hole in the ground approximating the size and shape of the columnar body of the pile to be formed, d. inserting the guide core with the preassembled elongated elements, collars, and deflector means contained therein into the hole, e. applying forces to said first plurality of elongated elements to drive the bottom ends thereof downwardly into the ground through the bottom of the hole, f. applying forces to the collars so that said second plurality of elongated elements contacts the deflector means and are forced thereby downwardly and outwardly through the wall of the hole into the ground, g. withdrawing the guide core from the hole, and h. grouting the hole to form a solid pile body which has the upper ends of the first and second plurality of elongated elements and the collars embedded therewithin.

* * * * *